US006139168A

United States Patent [19]

Gary et al.

[11] Patent Number: 6,139,168

[45] Date of Patent: Oct. 31, 2000

[54] DECORATIVE TREE-LIKE ILLUMINATED DISPLAY SYSTEM

[75] Inventors: Lonnie F. Gary, Ransom Canyon; Stephen L. Fillipp; Andrew G. Avinger, both of Lubbock, all of Tex.

[73] Assignee: Gary Products Group, Inc., Lubbock, Tex.

[21] Appl. No.: 09/235,856

[22] Filed: Jan. 22, 1999

Related U.S. Application Data

[60] Provisional application No. 60/104,098, Oct. 13, 1998.

[51] Int. Cl.[7] ..... F21S 13/14

[52] U.S. Cl. ..... 362/252; 362/122; 362/123; 428/7; 428/8; 428/20; 428/198

[58] Field of Search ..... 362/122, 123, 362/252; 428/7, 8, 20, 198

[56] References Cited

U.S. PATENT DOCUMENTS

| | | | |
|---|---|---|---|
| D. 250,519 | 12/1978 | Hashimoto | D11/118 |
| D. 287,769 | 1/1987 | Davis | D26/25 |
| D. 347,598 | 6/1994 | Maddox, Jr. | D11/118 |
| D. 374,638 | 10/1996 | Jacobson et al. | D11/121 |
| D. 408,319 | 4/1999 | Byers | D11/118 |
| 2,113,038 | 4/1938 | Thalinger | 41/15 |
| 2,919,810 | 1/1960 | Pease | 211/26 |
| 3,096,943 | 7/1963 | Forrer | 240/10 |
| 4,145,731 | 3/1979 | Adamich | 362/123 |
| 4,404,621 | 9/1983 | Mauro | 362/419 |
| 4,428,988 | 1/1984 | Adinamis | 428/8 |
| 4,736,282 | 4/1988 | Abroni | 362/123 |
| 4,746,022 | 5/1988 | Benham | 211/195 |
| 4,968,541 | 11/1990 | McCrory | 428/9 |
| 5,823,659 | 10/1998 | Klose | 362/252 |

*Primary Examiner*—Stephen Husar
*Assistant Examiner*—Ali Alavi
*Attorney, Agent, or Firm*—Locke Liddell & Sapp LLP

[57] ABSTRACT

A frame for supporting lights above a surface includes a plurality of spaced apart spiral strips extending between a location above the surface and a location on the surface. The strips are adapted to receive the lights. A plurality of connectors interconnect ones of the plurality of strips at spaced apart intervals along the strips to form a unitary structure. The strips in an unassembled position are coplanar and in an assembled extend position between the location above the surface and the surface.

20 Claims, 7 Drawing Sheets

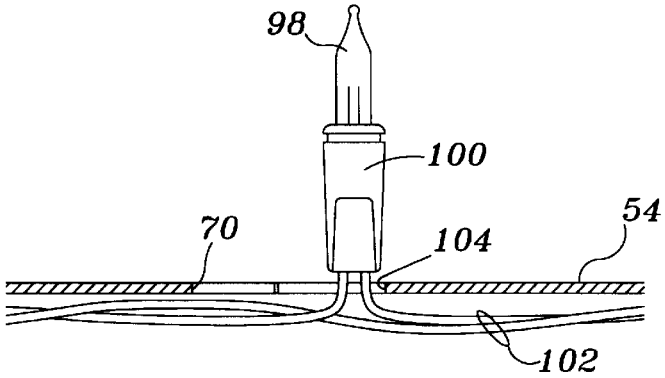
FIG. 4
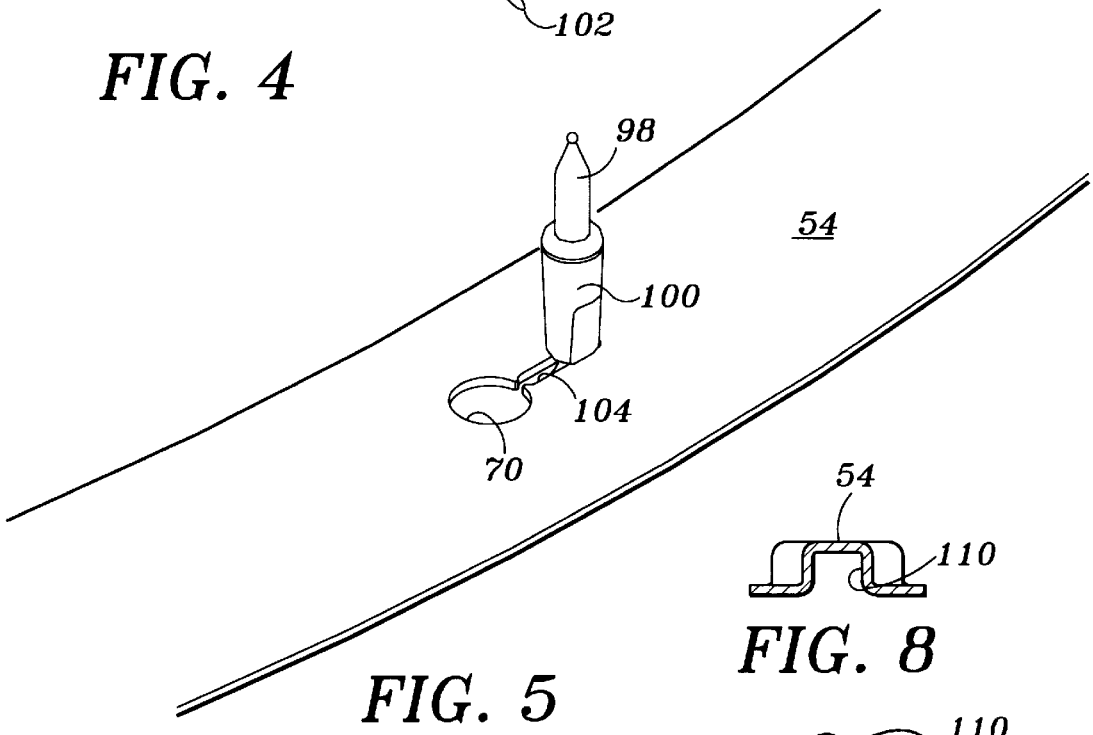
FIG. 5
FIG. 8
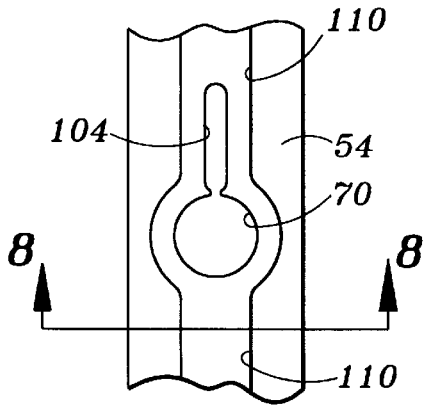
FIG. 7
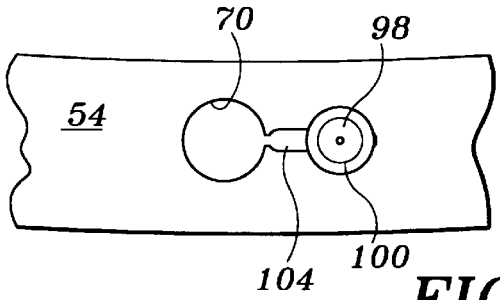
FIG. 6

DECORATIVE TREE-LIKE ILLUMINATED DISPLAY SYSTEM

RELATED APPLICATION

This application relies on Provisional Application Ser. No. 60/104,098 filed Oct. 13, 1998, and entitled "TREE-LIKE ILLUMINATED DISPLAY SYSTEM".

TECHNICAL FIELD OF THE INVENTION

The present invention relates to decorative lighting systems, and more particularly to a tree-like illuminated display system.

BACKGROUND OF THE INVENTION

Seasonal outdoor yard decorations, particularly during the Christmas season, include simulated "trees" consisting of a series of miniature Christmas light sets strung from the top of a pole to a circle configured on the ground. In this manner, a cone of lights is created from the linear strings which converge to a point at the top of the "tree". Although a tree-like impression is created by this pattern of lights, the nature of the linear strings, the fact that the strings converge to a point at the top of the pole, and because of the higher density of lights at the top than at the bottom of the "tree", the display does not create a "natural" simulated appearance of a tree.

A need has thus arisen for a more "natural" tree-like illuminated display system that eliminates the linearity and non-uniform distribution of lights found on existing displays. A need has arisen for a display system that is easy to set up and which provides for a more random, natural, appearing tree-like illuminated display.

SUMMARY OF THE INVENTION

In accordance with the present invention, a frame for supporting lights above a surface is provided. The frame includes a plurality of spaced apart spiral strips extending between a location above the surface and a location on the surface. The strips are adapted to receive the lights. A plurality of connectors interconnect ones of the plurality of strips at spaced apart intervals along the strips to form a unitary structure.

In accordance with another aspect of the present invention, a frame for supporting lights above a surface includes a sheet of material including a plurality of arcuate cuts to form a plurality of spaced apart strips. The strips in an unassembled position are coplanar and in an assembled position, the strips extend between a location above the surface and a location on the surface. These strips are adapted to support the lights.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which:

FIG. 4 is a side elevational view of a socket and lamp inserted in a strip of the present frame;

FIG. 5 is a perspective view of the socket and lamp illustrated in FIG. 4;

FIG. 6 is a top plan view of the socket and lamp illustrated in FIG. 4;

FIG. 7 is a top plan view of an alternate embodiment of a present strip;

FIG. 8 is a sectional view taken generally along sectional lines 8—8 of FIG. 7 illustrating an alternate embodiment of the present strip;

DESCRIPTION OF THE PREFERRED EMBODIMENTS

Figure 1A:
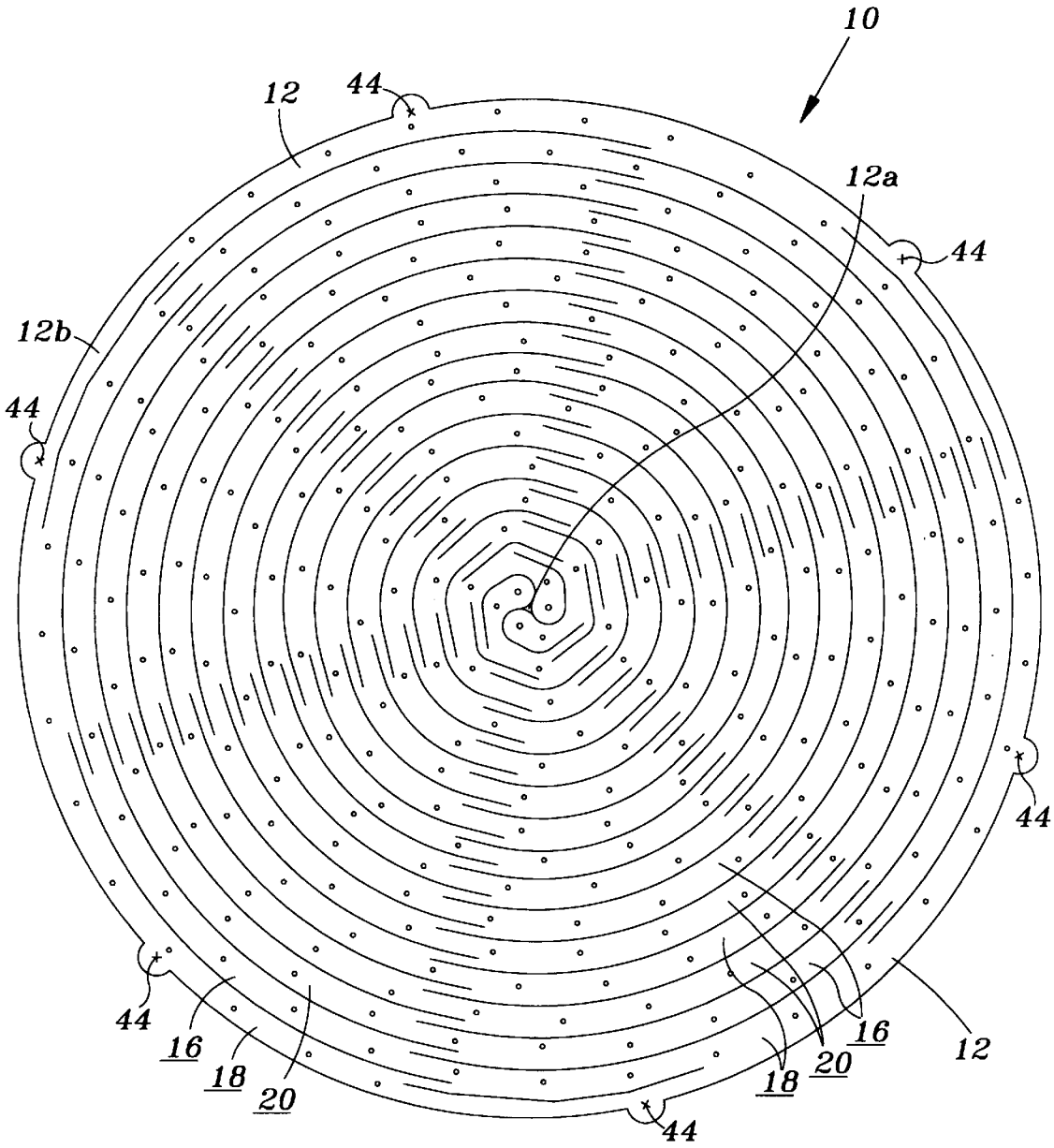
FIG. 1*a* is a top plan view of the present frame for supporting lights in an unassembled position.
Figure 1B:
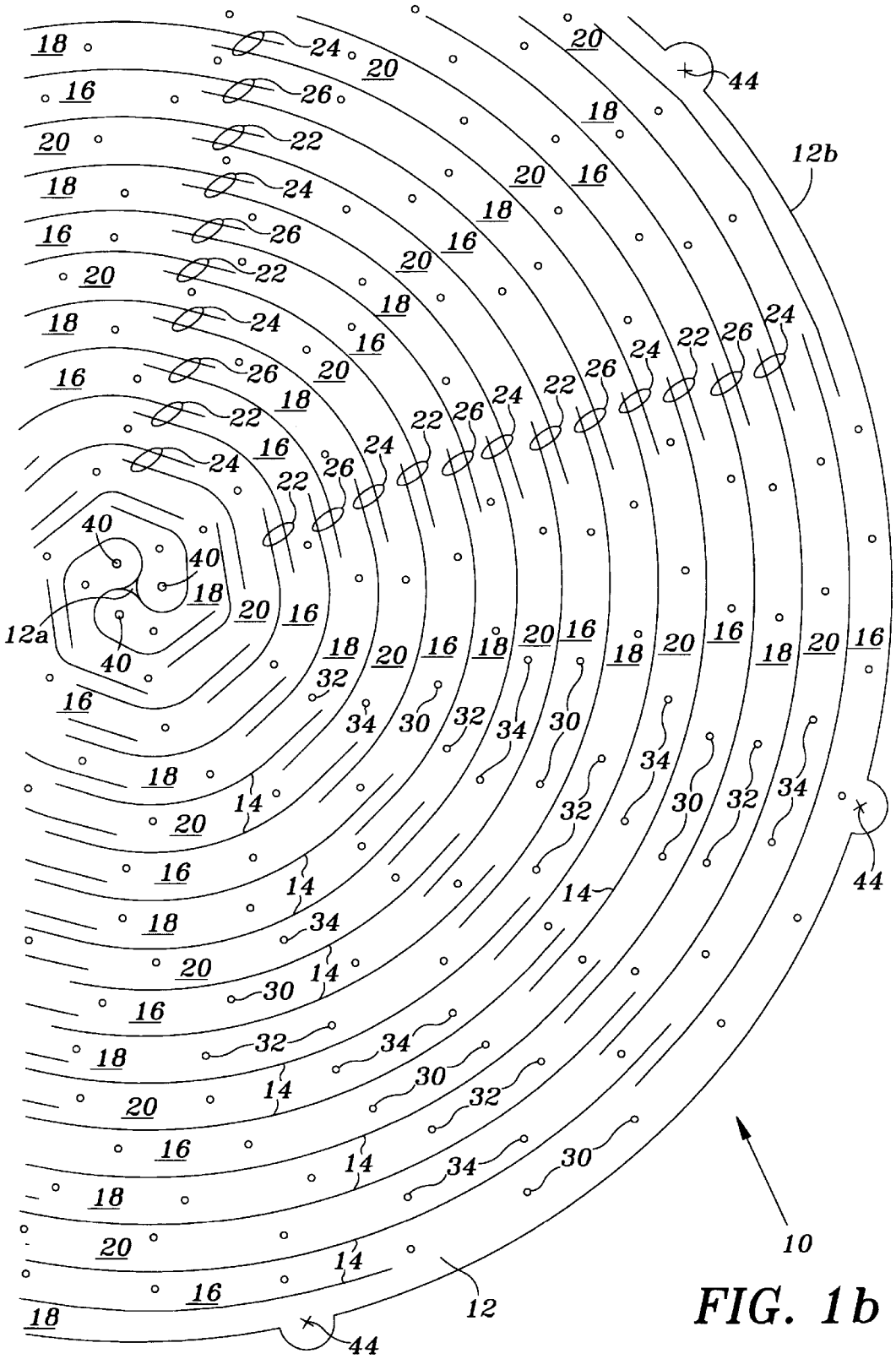
FIG. 1*b* is an enlarged top plan view of a portion of the present frame illustrated in FIG. 1*a;*

Referring to FIGS. 1*a* and 1*b,* the present system generally identified by the numeral 10 includes a flat frame or sheet 12. FIG. 1 illustrates sheet 12 in the unassembled position of system 10. Sheet 12 is cut along cut lines 14 to form three independent, spaced apart, and nested spiral strips 16, 18, and 20. Strips 16, 18, and 20 extend from the center 12*a* of sheet 12 to the perimeter 12*b* of sheet 12.

Interconnecting strips 16, 18, and 20 are a plurality of arcuate bridges 22, 24, and 26 which remain uncut between adjacent spiral strips 16, 18, and 20. Bridges 22, 24, and 26 are positioned at regular angular intervals around sheet 12, such that sheet 12 including strips 16, 18, and 20 form a unitary structure. Bridges 22 interconnect strips 16 and 20. Bridges 24 interconnect strips 18 and 20. Bridges 26 interconnect strips 16 and 18.

Strips 16, 18, and 20 each contain a plurality of apertures for mounting light bulbs, such as, for example, miniature Christmas tree lights as will subsequently be described with respect to FIGS. 4, 5, and 6. Strip 16 includes a plurality of apertures 30. Strip 18 includes a plurality of apertures 32. Strip 20 includes a plurality of apertures 34.

At the center 12*a* of sheet 12, each strip 16, 18, and 20 includes a pole mounting aperture 40. Apertures 40 overlap and are received by a pole (FIG. 3) when system 10 is in the assembled position.

Figure 3:
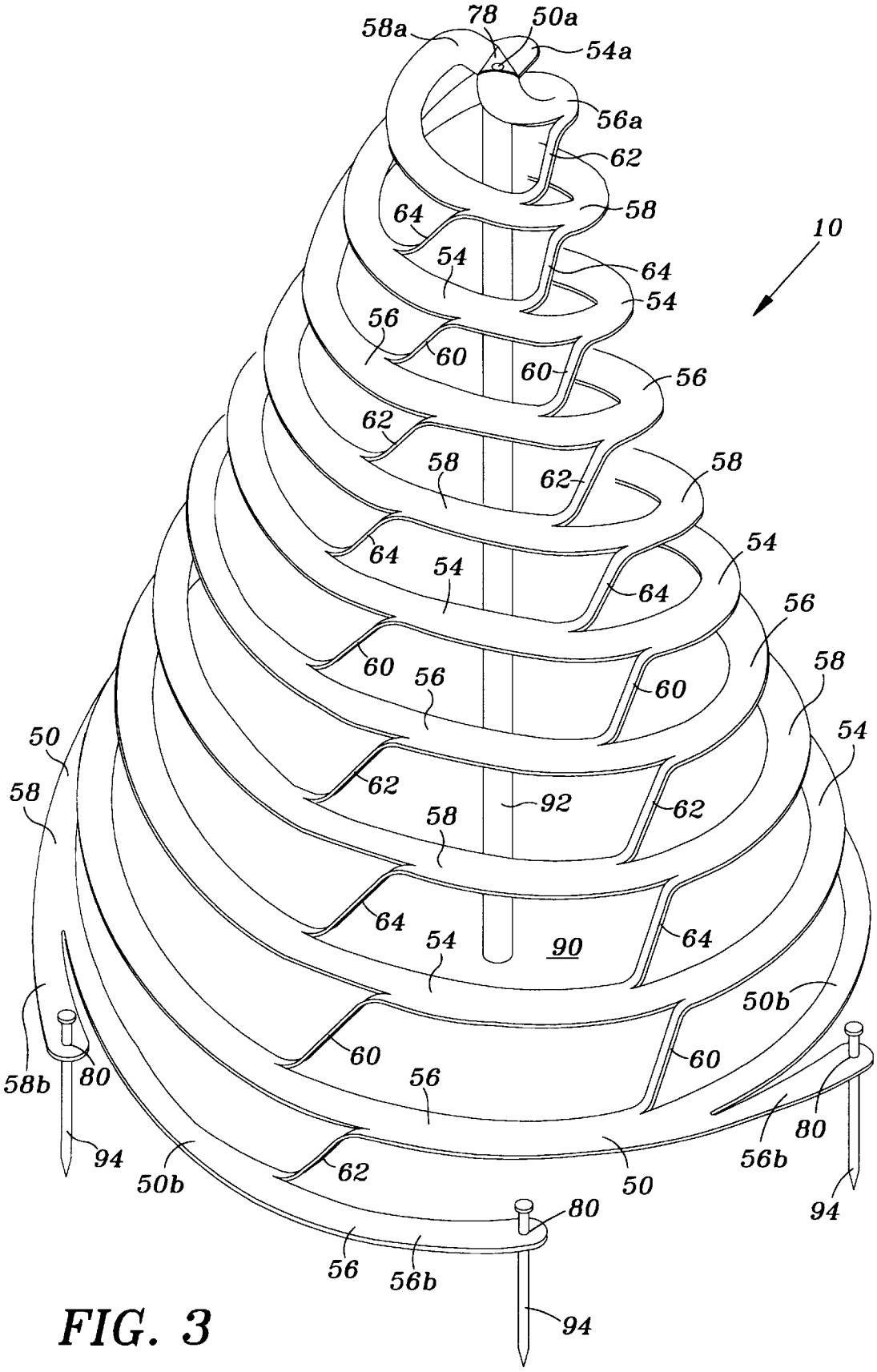
FIG. 3 is a side elevational view of the present frame shown in FIG. 2 in the assembled position.

During assembly, the perimeter 12*b* of sheet 12 is placed on a support surface. The perimeter 12*b* is staked to the support surface at locations 44. Center 12*a* of sheet 12 is then pulled upwardly and supported by a pole 92 as illustrated in FIG. 3. Alternatively, sheet 12 is supported by structure located above the center 12*a* of sheet 12. Strips 16, 18, and 20 descend at regular intervals when sheet 12 is in the assembled position, creating a cone-shaped display of lights that simulates the appearance of a real tree with lights evenly distributed around the periphery of the branches resulting in a cone shape.

Figure 2:
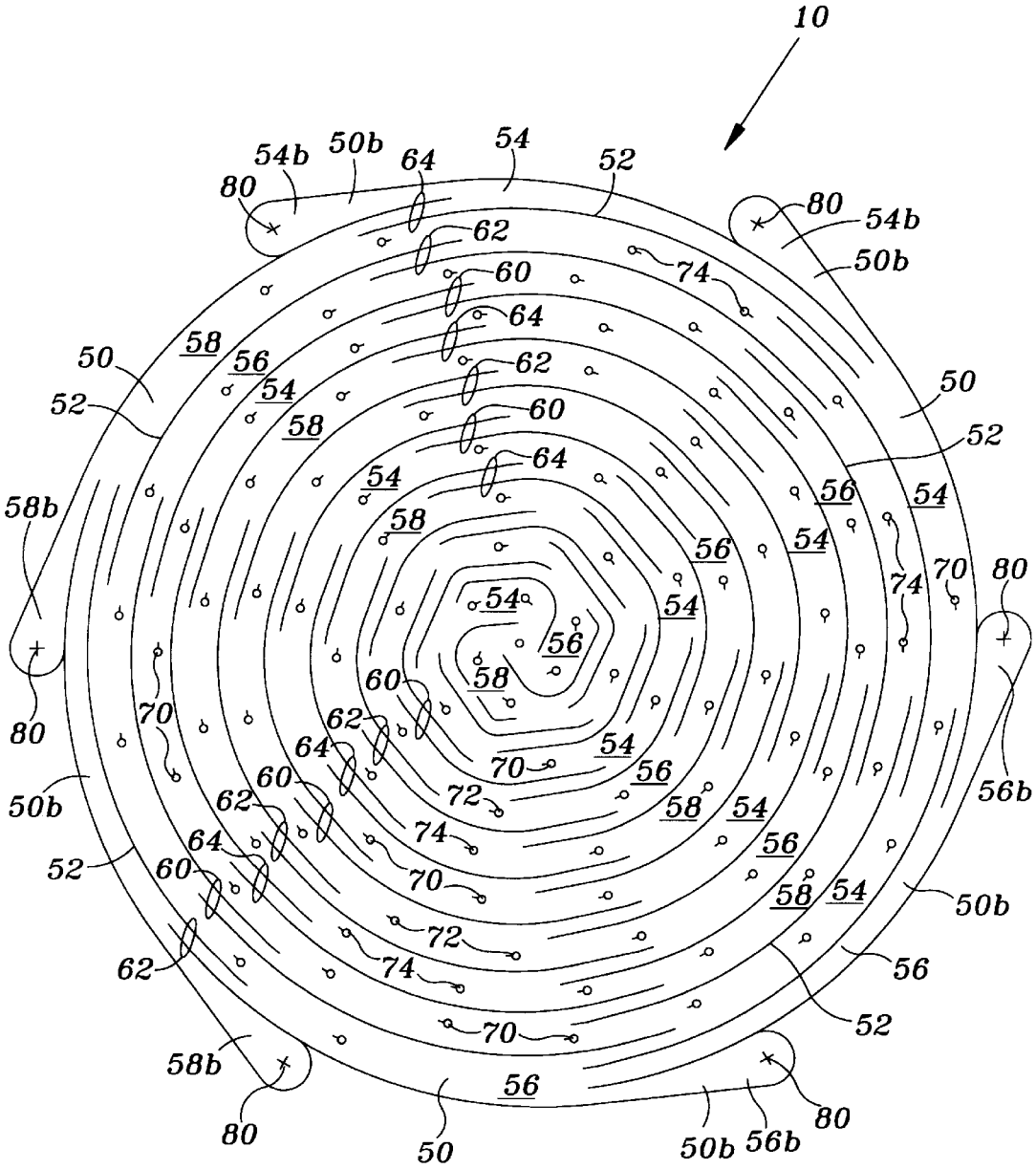
FIG. 2 is a top plan view of an additional embodiment of the present frame for supporting lights in an unassembled position.

Referring to FIG. 2, an alternative configuration of the frame of the present system 10 is illustrated, and is generally identified by numeral 50. Sheet 50 is illustrated in FIG. 2 in the unassembled position of system 10. Sheet 50 is cut along lines 52 to form three independent spaced apart spiral strips 54, 56, and 58. Strips 54, 56, and 58 extend in from the center 50*a* of sheet 50 to the perimeter 50*b* of sheet 50. Spirals formed by strips 54, 56, and 58 increase in size as the strips extend from center 50*a* to perimeter 50*b* of sheet 50. Strips 54, 56, and 58 are concentric about an axis extending through center 50*a* of sheet 50. Ends 54*a*, 56*a*, and 58*a* (FIG. 3) are disposed at the center 50*a* of sheet 50. Ends 54*b*, 56*b*, and 58*b* extend to perimeter 50*b* of sheet 50.

Interconnecting strips 54, 56, and 58 are a plurality of bridges 60, 62, and 64 of sheet material 50 which remain uncut between adjacent strips 54, 56, and 58. Bridges 60, 62, and 64 are positioned at regular angular intervals around sheet 50, and together with strips 54, 56, and 58 form an integral structure for system 10. Bridges 60 interconnect strips 54 and 56. Bridges 62 interconnect strips 56 and 58. Bridges 64 interconnect strips 58 and 54.

Strips 54, 56, and 58 each contain a plurality of apertures for mounting light bulbs, such as, for example, miniature Christmas tree lights. As will subsequently be described with respect to FIGS. 4, 5, and 6. Strip 54 includes a plurality of apertures 70. Strip 56 includes a plurality of apertures 72. Strip 58 includes a plurality of apertures 74.

At the center 50*a* of sheet 50, each strip 54, 56, and 58 includes an aperture 78 for receiving a pole 92 (FIG. 3) when system 10 is assembled. Additionally, frame 50 may be supported from a structure disposed above frame 50 interconnected to aperture 78.

As previously described with respect to frame 12, during installation of frame 50, the perimeter 50*b* of sheet 50 is placed on a support surface. The perimeter 50*b* is staked to the support surface at locations 80. Each strip at ends 54*b*, 56*b*, and 58*b* includes two locations 80 for connection to a support surface. Center 50*a* of sheet 50 is then pulled upwardly and supported through aperture 78. Strips 54, 56, and 58 descend at regular intervals when installation is complete, creating a cone-shaped display of lights that simulates the appearance of a real lighted tree, with lights evenly distributed around the periphery of the branches of the tree resulting in a cone shape.

Sheets 12 and 50 may be fabricated from, for example, a plastic sheet of material including thermoplastic, polyethylene, polyvinyl chloride, copolymers, and vinyl materials. Additionally, sheets 12 and 50 may be fabricated from metal, or composite materials including a fabric mesh, fiberglass, and resin combinations. Sheets 12 and 50 may be fabricated by injection molding, extrusion, or vacuum forming. Cut lines 14 and 52 may be formed within sheets 12 and 50, respectively through die cutting, use of a router, or where sheet 12 and 50 are vacuum formed, through die cutting along areas having reduced thicknesses. The thickness of sheets 12 and 50 may range between 30 mils and 60 mils for high density polyethylene material.

FIG. 3 illustrates system 10 in the assembled position in which sheet 50 has been extended such that strips 54, 56, and 58 extend between center 50*a* located above a support surface 90 and the perimeter 50*b* disposed on the support surface 90. Ends 54*a*, 56*a*, and 58*a* of strips 54, 56, and 58, respectively, are disposed above surface 90. Ends 54*b*, 56*b*, and 58*b* of strips 54, 56, and 58, respectively, are mounted to surface 90, using, for example, stakes 94. Strips 54, 56, and 58 are supported above surface 90 by a pole 92. Pole 92 may comprise a continuous structure, or be assembled from multiple components in a telescoping configuration. Alternatively, center 50*a* of sheet 50 may be supported from a structure disposed above center 50*a* such as, for example, a supporting line extending from a ceiling of a room or from a roof external of a dwelling. Bridges 60, 62, and 64 maintain the spacing between strips 54, 56, and 58 evenly distributed above support surface 90.

Referring simultaneously to FIGS. 4, 5, and 6, a strip 54 is illustrated showing installation of a light bulb 98 and socket 100, it being understood that each strip 16, 18, 20, 54, 56, and 58 include similarly mounted light bulbs 98 and sockets 100. Socket 100 includes electrical wires 102 adapted to be connected to a power source for illuminating light bulbs 98. Socket 100 is inserted within aperture 70 and is slid through a connected slotted aperture 104 which retains socket 100 in place on strip 54. Apertures 70 and 104 form a "keyhole" arrangement for positively affixing socket 100 to strips 16, 18, 20, 54, 56, and 58. Apertures 70 and 104 may be die cut into sheets 12 and 50, or integrally molded into strips 16, 18, 20, 54, 56, or 58. Additional structure for mounting sockets 100 to a strip include, for example, mechanical snap connections and Velcro fasteners.

Referring now to FIGS. 7 and 8, a strip 54 is illustrated which is formed by a vacuum forming process to create a channel 110 disposed on the lower surface of strip 54. Channel 110 is disposed to receive electrical wires 102.

Figure 9:
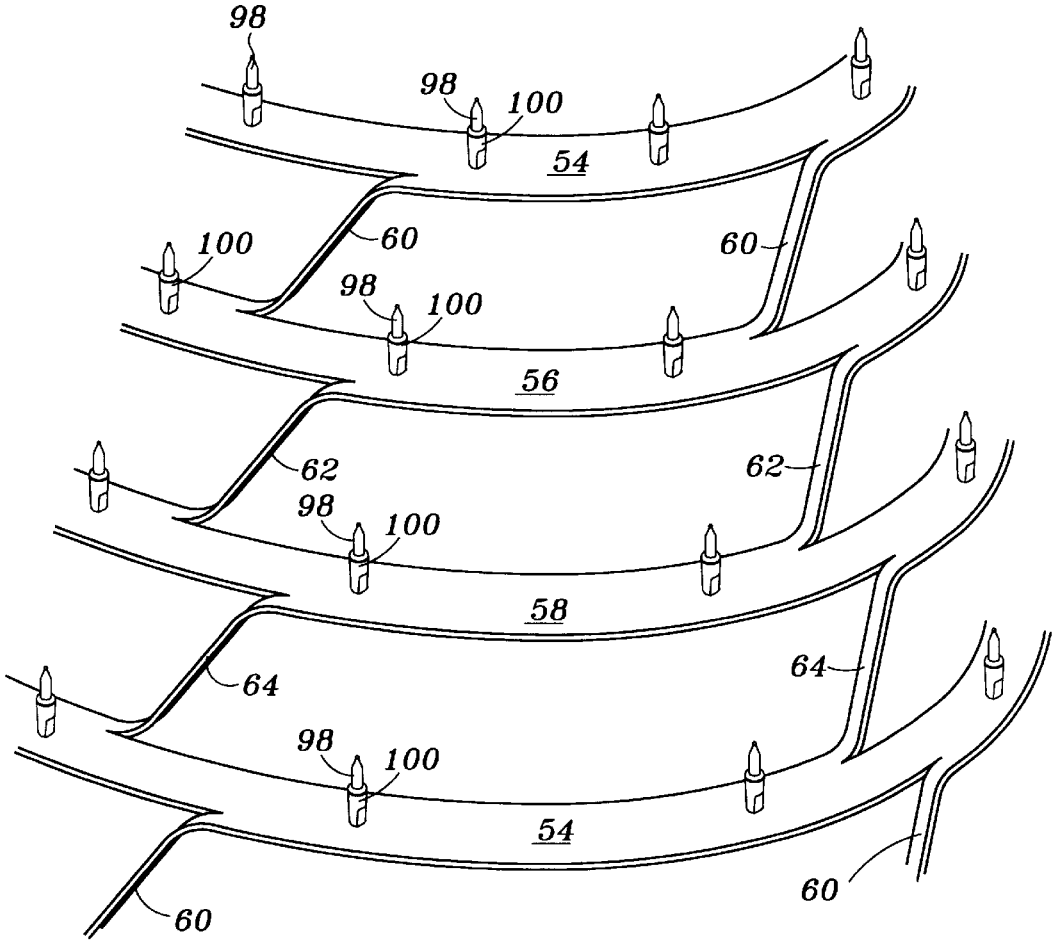
FIG. 9 is an enlarged side view of a portion of the present frame in the assembled position.

Referring now to FIG. 9, an enlarged portion of an assembled system 10 including sheet 50 is illustrated. FIG. 9 illustrates bridges 60, 62, and 64 creating a continuous, evenly spaced apart distribution of strips 54, 56, and 58. The length of bridges 60, 62, and 64 determines the spacing between strips 54, 56, and 58.

Figure 10:
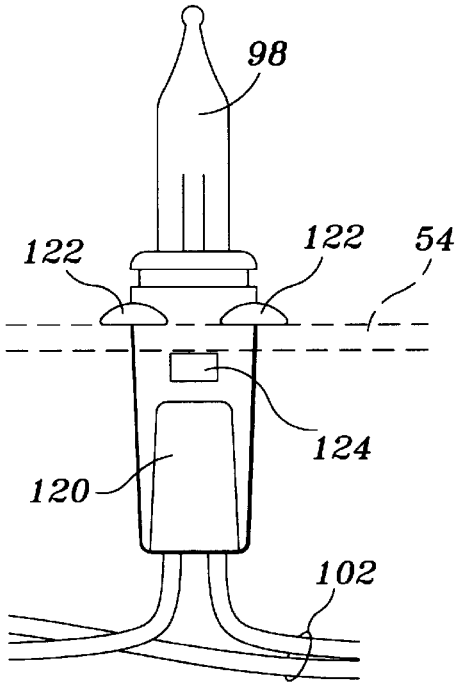
FIG. 10 is a side elevational view of a socket and lamp inserted in a strip of the present frame.
Figure 11:
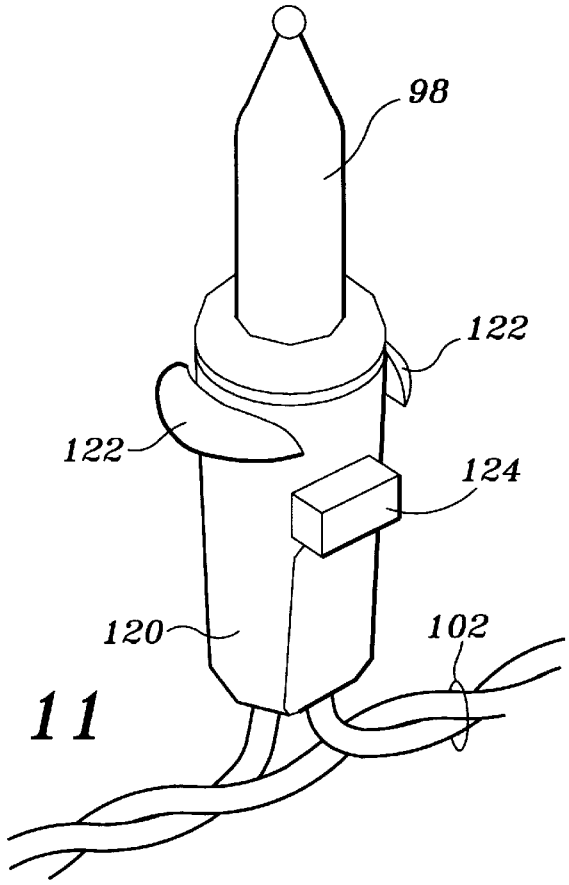
FIG. 11 is a perspective view of the socket and lamp illustrated in FIG. 10.
Figure 12:
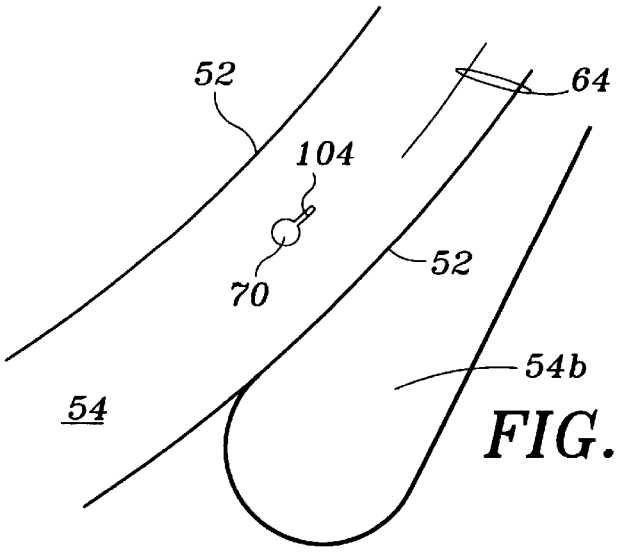
FIG. 12 is a top plan view of a present strip.

Referring simultaneously to FIGS. 10, 11, and 12, an additional socket 120 for use with the present system 10 is illustrated. Socket 120 mounts light bulbs 98 to strips 16, 18, 20, 54, 56, and 58 by engaging the strips between bosses 122 and 124. Bosses 122 engage the top surface of a strip, while bosses 124 engage the bottom surface of a strip. Bosses 122 and 124 are molded to socket 120. Socket 120 is inserted through apertures such as, for example, apertures 70 (FIG. 12) within a strip of system 10.

The diameter of sheets 12 and 50 may comprise, for example, 30 inches to 33 inches resulting in a "tree" having a height of approximately 4 to 5 feet above the support surface 90. Light bulbs 98 and sockets 100 or 120 may be preassembled to frames 12 and 50 or may be inserted by the user when installing system 10. Separate colored light strings may be attached to each strip 16, 18, and 20 of sheet 12 or strips 54, 56, or 58 of sheet 50. The distance between sockets 100 or 120 may comprise, for example, 4.5 inches.

It therefore can be seen that the present system 10 is easy to install, by expanding frame 12 or 50 from the flat, unassembled position as illustrated in FIGS. 1*a*, 1*b*, and 2 to the expanded position illustrated in FIG. 3. The present invention results in the creation of a tree-like illuminated display having a uniform distribution of lights.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. A frame for supporting lights around a central axis and above a surface comprising:

a plurality of spaced apart and nested spiral strips, each of said plurality of strips including a first and second end and strip segments disposed between said first and second ends, each of said plurality of strips being continuous and disposed around the central axis, such that said strip segments are spaced apart from the axis by a variable distance, said variable distance from the axis being greater for strip segments closer to said second ends of said strips than for strip segments closer to said first ends of said strips, said first ends of said strips being disposed above the surface and said second ends of said strips being disposed adjacent to the surface;

said strips adapted to receive lights; and a plurality of connectors, interconnecting adjacent ones of said plurality of strips at spaced apart intervals around the axis to form a unitary structure.

2. The frame of claim 1 wherein said strips include a plurality of apertures for receiving the lights.

3. The frame of claim 1 and further including:

means for supporting said first ends of said plurality of strips above the surface.

4. The frame of claim 3 wherein said supporting means includes a pole positioned along the axis.

5. The frame of claim 1 wherein said strips include plastic material.

6. A lighting display system disposed about a central axis and above a surface comprising:

a plurality of spaced apart and nested spiral strips, each of said plurality of strips including a first and second end and strip segments disposed between said first and second ends, each of said plurality of strips being continuous and disposed around the central axis, such that said strip segments are spaced apart from the axis by a variable distance, said variable distance from the axis being greater for strip segments closer to said second ends of said strips than for strip segments closer to said first ends of said strips, said first ends of said strips being disposed above the surface and said second ends of said strips being disposed adjacent to the surface;

a plurality of connectors, interconnecting adjacent ones of said plurality of strips at spaced apart intervals around the axis to form a unitary structure; and a plurality of lights attached to said strips.

7. The system of claim 6 wherein said plurality of lights include electrical wires adapted to be connected to a power source.

8. The system of claim 7 and further including means for attaching said electrical wires to said strips.

9. The system of claim 6 wherein said strips include a plurality of apertures for receiving said plurality of lights.

10. The system of claim 6 and further including:

means for supporting said first ends of said plurality of strips above the surface.

11. The system of claim 10 wherein said supporting means includes a pole positioned along the axis.

12. The system of claim 6 wherein said strips include plastic material.

13. The system of claim 6 and further including means for attaching said second ends of said plurality of strips to the surface.

14. The system of claim 6 wherein said plurality of connectors each comprise an arcuate strip having a length, such that said length determines said spacing between said strips.

15. A frame for supporting lights above a surface comprising:

a sheet of material including a plurality of continuous arcuate cuts to form a plurality of interconnected and nested spiral shaped strips, said strips being adapted to support the lights; and said sheet having an unassembled position in which said strips are coplanar, and an assembled position in which each of said strips are spaced apart and extend between a location above the surface and a location adjacent to the surface.

16. The frame of claim 15 and further including:

a plurality of connectors interconnecting said plurality of strips, said connectors including portions of said sheet material disposed between ones of said arcuate cuts and having a length, such that said length determines said spacing between said strips in said assembled position.

17. The frame of claim 15 wherein said sheet material includes plastic material.

18. The frame of claim 15 wherein said strips are spiral shaped.

19. The frame of claim 15 wherein said strips are of circular shape.

20. The frame of claim 15 wherein said strips include apertures for receiving lights.

* * * * *